United States Patent [19]

Avellone

[11] 4,367,125

[45] Jan. 4, 1983

[54] APPARATUS AND METHOD FOR PLATING METALLIC STRIP

[75] Inventor: Richard C. Avellone, Mayfield Heights, Ohio

[73] Assignee: Republic Steel Corporation, Cleveland, Ohio

[21] Appl. No.: 217,806

[22] Filed: Dec. 18, 1980

Related U.S. Application Data

[63] Continuation-in-part of Ser. No. 22,618, Mar. 21, 1979, abandoned.

[51] Int. Cl.[3] ..... C25D 5/02; C25D 7/06; C25D 17/00

[52] U.S. Cl. ..... 204/28; 204/206; 204/211

[58] Field of Search ..... 204/15, 28, 206, 211

[56] References Cited

U.S. PATENT DOCUMENTS

| | | | |
|---|---|---|---|
| 1,991,817 | 2/1935 | Nachtman | 204/28 |
| 2,244,423 | 6/1941 | Hall | 204/28 |
| 2,462,506 | 2/1949 | Klein | 204/225 |
| 2,477,808 | 8/1949 | Jones | 204/211 |
| 2,490,055 | 12/1949 | Hoff | 204/206 |
| 2,569,577 | 10/1951 | Reading | 204/28 |
| 2,695,269 | 11/1964 | DeWitz | 204/206 |
| 2,723,953 | 11/1955 | Burgemeister | 204/211 |
| 2,924,563 | 2/1960 | Gray | 204/198 |
| 2,989,445 | 6/1961 | Lloyd | 204/28 |
| 3,354,070 | 11/1967 | Carter | 204/206 |
| 3,445,371 | 5/1969 | Johnston | 204/206 |
| 3,468,783 | 9/1969 | Avellone | 204/28 |
| 3,644,181 | 2/1972 | Donaldson | 204/15 |
| 3,692,640 | 9/1972 | Hamabe | 204/28 |
| 3,697,399 | 10/1972 | Usui | 204/15 |
| 3,855,083 | 12/1974 | Hoeckelman | 204/28 |
| 3,901,771 | 8/1975 | Froman | 204/28 |
| 3,975,242 | 8/1976 | Matsuda | 204/28 |
| 3,988,216 | 10/1976 | Austin | 204/28 |
| 3,989,604 | 11/1976 | Austin | 204/28 |
| 4,014,773 | 3/1977 | Furuya | 204/206 |
| 4,119,516 | 10/1978 | Yamaguchi | 204/206 |

*Primary Examiner*—T. M. Tufariello

*Attorney, Agent, or Firm*—Watts, Hoffmann, Fisher & Heinke Co.

[57] ABSTRACT

Method and apparatus for electrogalvanizing one or both sides of a steel workpiece are disclosed. A series of insoluble apertured plating anodes are positioned in spaced relation to the workpiece. When one side is to be plated one or more anodes are preferably mounted above the strip and when both sides are plated, anodes are mounted both above and below the strip. Solution is pumped through the holes in the anodes to momentarily contact the workpiece and they fall into a sump to be recirculated. A potential difference between the anode or anodes and the workpiece causes current flow through the electrolyte solution to electroplate the workpiece. Solution collected by the sump is directed to a reaction station for replenishment of the zinc metal ion. The solution is then filtered back to a main reservoir tank from which it is again pumped to the plating anodes.

13 Claims, 10 Drawing Figures

APPARATUS AND METHOD FOR PLATING METALLIC STRIP

This application is a continuation-in-part of United States patent application Ser. No. 022,618, filed Mar. 21, 1979, abandoned.

DESCRIPTION

1. Technical Field

It is customary to use galvanized steel product in applications where, but for a protective zinc coating, the life of the product would be unacceptably short. Until relatively recently, it was customary to protect an entire product with a galvanized coating. Either strip steel which had been zinc coated was employed in fabrication or, alternatively, a finished product was fabricated and then coated with zinc.

2. Background Art

In relatively recent times, applications have developed where it is economically or otherwise desirable to galvanize only one surface of a strip of steel. Other applications require coatings of different thickness on opposed strip surfaces.

Examples where a one-side coated steel is used are wall panels for buildings and automotive components. Automobile rocker panels, for example, frequently are heavily galvanized on their internal surfaces to inhibit corrosive attack by water trapped inside the panels, especially when that water contains road salt or other chemicals, while the external surfaces are provided with a smooth uncoated finish for appearance.

A differential coating is often desirable for automotive parts. A relatively thick coating of zinc is applied to interior surfaces of the part and a thin coating is applied to exterior surfaces. The thin exterior coating inhibits corrosion in the event of scraping and/or denting of the car finish.

While a need exists for steel which is galvanized on one surface, or alternately in a differential manner to both surfaces, the techniques which have been used in the past were wasteful and inefficient, or required an enormous investment, or both.

One technique for one side coating is to hot dip the steel in molten zinc with one face treated in a manner that is intended to prevent its being coated. Techniques for keeping the zinc on one side of a thin, flat strip product, however, have been difficult to achieve. The hot dip technique has also physically changed the properties of the steel being plated and does not produce the uniformity of coating which can be achieved with electroplating techniques.

A second known technique is to use a conventional electrolytic strip plating line modified to maintain the level of plating solution at a level where it contacts only the lower surface of a strip of steel being plated, in hopes of plating only that lower surface. Unfortunately, even when the level of the plating solution is controlled very precisely, there is considerable splashover and marginal portions of the top surface of the strip become plated due to this splashing of the solution. With this technique the top coated marginal portions are cropped off and only a central portion of a strip produces a useful one-side coated product. The cropped portions typically are scrapped or used in applications which require poor quality steel because, although perhaps plated effectively on the lower surface, the splashed over surface is irregularly and poorly plated and not useful for products demanding quality strip.

Other techniques for one side plating have been developed which mask one surface while plating the other. For example it is known to provide a strip of soft steel that is reeved over rollers that are partially immersed in a plating bath and function to mask the surface which they contact as the opposite surface is plated. It will be appreciated that the apparatus is complex and requires a very significant capital investment. The required capital investment is heightened when one appreciates that for automotive applications the galvanized coating must be relatively heavy which means either slow throughput, or alternately for an efficient line, a relatively long and expensive line to develop the thick coating desired.

Most known electroplating systems use consumable electrodes. That is, the electrodes each include a rather large piece of zinc for anodic solution to replenish the zinc ions plated out onto the workpiece. As electrode zinc is consumed, electrode-to-workpiece spacing changes and due to this and other variables, very precise and uniform plating thickness is difficult to achieve.

Because of the variables which are inherent in consumable electrode plating the equipment and controls for systems performing such plating are expensive and complex. For example, sophisticated electrical controls have been developed which monitor and compensate for variations in several plating parameters in an attempt to achieve more uniform plating with consumable electrodes.

There also have been proposals to use nonconsumable electrodes. A nonconsumable electrode is a conductive material which is maintained at a potential differential with the workpiece so that current flow between the electrode and the workpiece will plate zinc ions onto the workpiece from an electrically conductive plating solution filling the space between the electrode and the workpiece. As the ions are reduced to the metallic state onto the workpiece, however, the solution adjacent or near the workpiece becomes depleted of zinc metal ions. High speed efficient plating cannot therefore be achieved with nonconsumable electrodes unless the proper concentration of the zinc ions is maintained by other means at the workpiece surface. Problems of replenishing or maintaining the zinc ion concentration have inhibited the performance of prior nonconsumable anode systems, with the result that they have not enjoyed significant commercial success.

The use of a nonconsumable anode is shown in U.S. Pat. No. 2,244,423, to Hall. The anode disclosed in that patent includes a series of apertures through which plating solution flows to contact a strip to be plated. While in theory capable of achieving one side and/or differential two side plating the Hall structure is deficient for a number of reasons.

The Hall structure allows the plating solution to flow off the strip but this flow is constricted by gutters which bound the strip. This constricted fluid flow can cause the solution's ion concentration near the strip to become depleted at an uncertain rate as plating occurs, with resultant non-uniformity of plating thickness.

A second deficiency of the Hall plating apparatus involves its orientation of anode and strip. With the anode mounted beneath the strip to plate the strip underside, it is possible that pockets of gas may collect on the strip as the plating process occurs. This problem is especially likely due to the gutter-caused constriction of fluid flow away from the strip. When a gas pocket forms, plating current from the anode to the strip is disrupted and non-uniform strip plating results.

A further problem inherent in the Hall structure is its use of multiple anodes across the workpiece which are separated by gaps. It is believed impossible to maintain such electrically isolated anodes at identical electrical potentials. Therefore, bi-polar plating action occurs between anodes. That is, a lower potential anode will act as a cathode to higher potential anodes and zinc will be plated onto the lower potential anode. Plating effectiveness of the plated anode is obviously reduced.

Use of separate anodes can result in non-uniform plating due also to non-uniform plating current density created by the gaps between anodes.

DISCLOSURE OF THE INVENTION

With the present invention, an improved insoluble anode plating technique especially adapted for galvanizing a strip of steel has been developed. According to the technique, an anode assembly is positioned in relatively closely spaced relationship with the workpiece. The assembly and workpiece are configured and located to define a fluid flow path for plating fluid. The plating fluid is supplied to the flow path in a quantity sufficient to maintain at least a portion of the flow path across the workpiece substantially filled at all times with flowing solution so that plating is accomplished continuously and uniformly across the entire width of the workpiece.

The solution flows from the fluid flow path, dropping into a sump where is it collected, sent to a zinc ion replenishment station and, once the zinc ions are replenished, recirculated through a filter and returned to the flow path.

The system of this invention has a number of distinct advantageous features. One such feature is means for selectively positioning the insoluble anode or anodes in relation to the strip so that fluid flows over only selected strip portions, such as over one side of the strip workpiece. Alternately, an anode may be positioned on both strip sides to provide a differential plating capability. Another major advantage is that because there is a relatively high rate of fluid flow, uniform metal ion replenishment rates are provided which overcome previous deficiencies of nonconsumable anode systems, that have in the past limited their use.

In a preferred embodiment of the invention, the anode is mounted near the strip, and defines, conjunctively with the strip, an insoluable anode container region for receiving the plating solution flow. The anode container comprises a plating surface of the anode parallel to the workpiece surface to be plated. Plating solution is pumped to the anode and passes through apertures in the anode's plating surface. The flowing solution contacts the steel strip surface and fills the gap between the anode and the strip. As the strip moves past the anode, plating occurs due to the current flow between the anode and the strip. The solution then flows from the edge of the strip and is caught by a sump tank for later recirculation to the anode. At a location removed from the anode container, a source of zinc ions continuously replenishes those ions used in the plating process.

One criterion that must be satisfied if uniform plating is to be achieved is the maintenance of a uniform gap between the anode and the strip. With a soluble anode the plating current becomes non-uniform due to changes in the physical configuration of the anode. The present invention's use of a insoluble anode removes this undesirable variable.

To achieve one side plating the anode is preferably positioned above the strip. If both sides are to be plated, anodes constructed in accordance with the invention may be positioned both above and below the strip. By adjusting the relative electrical potential between the strip and anodes a different coating thickness can be applied to each of the two strip surfaces.

When an anode is positioned below the strip, gas pockets may be prevented from accumulating on the strip and interfering with plating. The improved solution flow characteristics achieved through practice of the invention removes and prevents detrimental gas accumulations. Furthermore, according to one embodiment of the invention, both the strip and anode plating surfaces are mounted at an angle to the horizontal. The arrangement permits increased solution flow and metal ion replenishment, facilitates air and electrode gas removal and helps to maintain strip flatness and tension through the plating zone.

An important feature of the invention involves the control of current flow from the anode to the strip. To insure uniform plating thickness across the width of the strip, masking plates are inserted in the path of solution flow. These plates are electrically insulating and reduce plating current at the strip edges to reduce two undesirable phenomena known as "tree growth" and "edge buildup." As strips of varying widths are plated, these insulator plates or masks are adjusted appropriately to achieve the more uniform plating deposition.

If the strip is plated on both surfaces, the anodes may be vertically aligned one above the other with the strip passing between or the anodes may be staggered along the strip length. Positioning the top anode or anodes above the bottom anode or anodes is economical but can cause bi-polar plating action between opposed anodes. That is, the potential maintained on one of two closely positioned anodes may be higher than the potential of the other, causing zinc to be plated on the lower potential anode. In the present invention, the plating of an anode by bipolar action is avoided by use of the insulated masking plates which are inserted between the two anodes. The masks inhibit plating current from flowing between the anodes and thus inhibit plating of the lower potential anode.

The use of a single anode on each side of the strip to be plated inhibits bi-polar plating, as compared to previous proposals for use of plural adjacent anodes.

From the above it is apparent that one object of the present invention is to provide apparatus and method for one-side, two-side or for two-side differential plating of a strip of steel or the like. Use of a flat non-soluble anode insures that uniformity of the preset gap between anode and strip does not change during electrolysis. Electrical insulators placed within or near the gap enhance uniformity of plating across the width of the strip. These and other features of the present invention will become more apparent as the invention becomes better understood from the detailed description that follows, when considered in connection with the accompanying drawings.

BEST MODE FOR CARRYING OUT THE INVENTION

Figure 1:
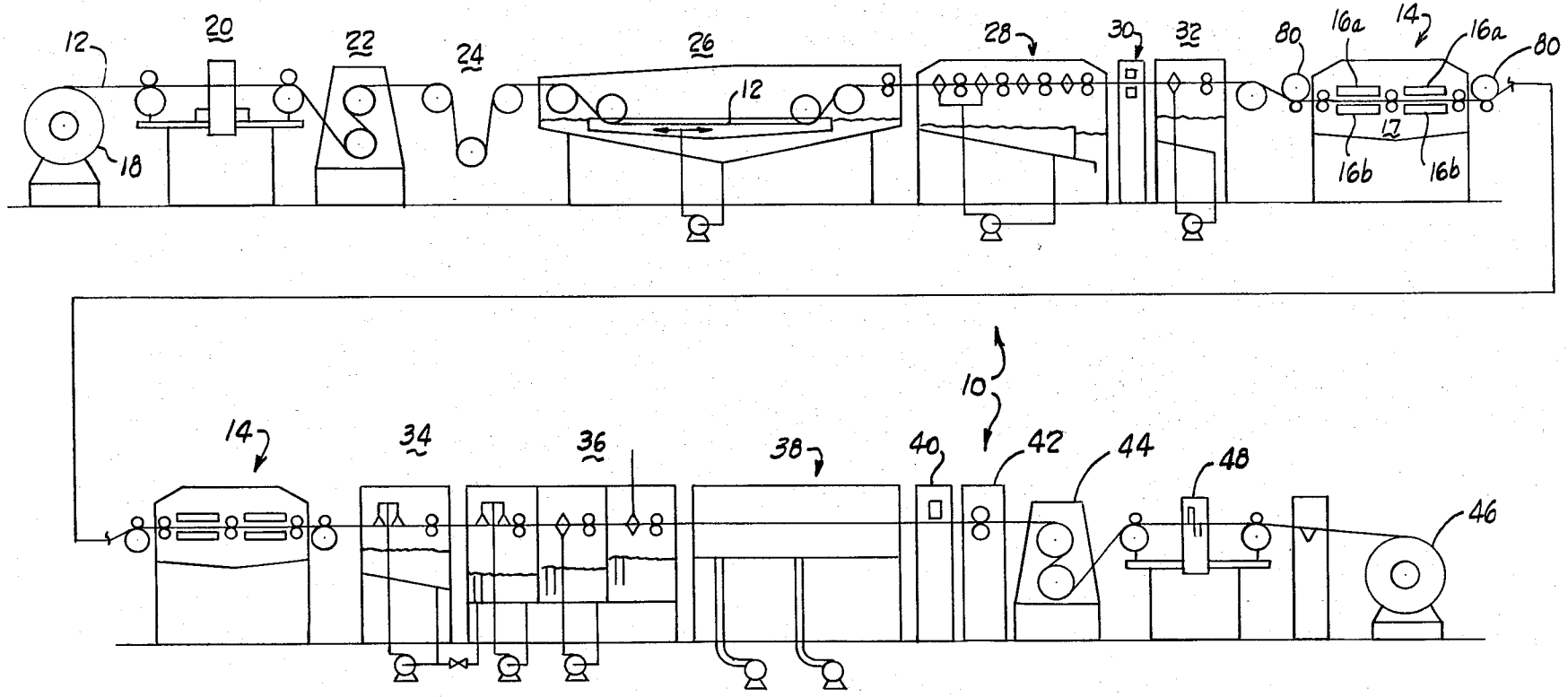
FIG. 1 is a graphical illustration of a plating line incorporating the present invention.

Turning now to the drawings, FIG. 1 shows a plating line 10 constructed in accordance with the present invention. The line is particularly suited for applying a zinc coating to one or both sides of a steel strip 12. A plating section 14 comprising a portion of the line includes a number of anodes 16 mounted both above and below the strip. Those anodes 16*a* positioned above the strip provide plating current through a zinc ion containing solution 17 to plate zinc onto the strip's upper surface and those anodes 16*b* positioned below the strip provide a similar plating current for zinc plating the strip's bottom surface.

A number of preparatory steps upstream of the plating section must be performed prior to plating. As a first step, the strip must be unwound from a payoff reel 18 and fed to a welding station 20. At the welding station 20 the end of one strip is welded to the beginning of the strip to be unwound from the payoff reel 18 to form a continuous strip to be plated. During the welding step strip motion is stopped.

Following the welding station 20 the strip is fed through a drag bridle roll 22 and a strip tracking control 24. The drag bridle roll 22 maintains tension in the strip and the tracking control 24 assures that the strip is centered along its path of travel.

After exiting the tracking control the strip is fed through an alkaline cleaner or the like followed by an acid cleansing bath 26 comprising a suitable acid such as hydrochloric acid. The acid removes foreign substances and/or oxides from the steel and prepares the steel surface for electroplating. After the strip exits the acid bath any acid clinging to the strip is rinsed off at a scrubber/rinse station 28.

Prior to entering the plating section 14 the centering of the strip is checked at a track monitoring station 30 and if the strip is off center corrective steps are taken at the tracking control station 24 to recenter the strip.

Immediately prior to entering the plating section 14 a zinc spray is applied at a strip conditioner station 32. Application of the zinc spray causes enhanced plating performance by acting as a seed for the plating process and also makes sure the strip is wet when it enters the plating section 14.

After one or both of the strip's surfaces are plated by a process to be described, the strip leaves the plating section 14 and enters a zinc reclaiming station 34. At this station plating bath solution withdrawn on the strip surface is collected. The strip 12 is then rinsed and dried at a rinsing station 36 and a drying station 38 respectively.

The coating weight of the dry strip is measured at a coating weight station 40. If the coating weight is not equal to a desired value corrective measures are taken. These measures include strip speed adjustment and changing the potential difference between some or all the anodes and the strip.

After the strip is tested for coating weight it passes through a brush wipe 42 and an exit bridle roll 44 and is stored on a coiling reel 46. Periodically strip motion is stopped, the strip is cut by an exit shear 48, a full coiling reel is removed, and an empty coiling reel is positioned for receiving more zinc coated strip.

The line 10 can be adapted for either one or two side plating. When only one side is plated, according to the preferred embodiment of the invention only the upper anodes 16*a* are mounted in relation to the strip. Details of one side only strip plating are illustrated in FIGS. 2–6.

Figure 2:
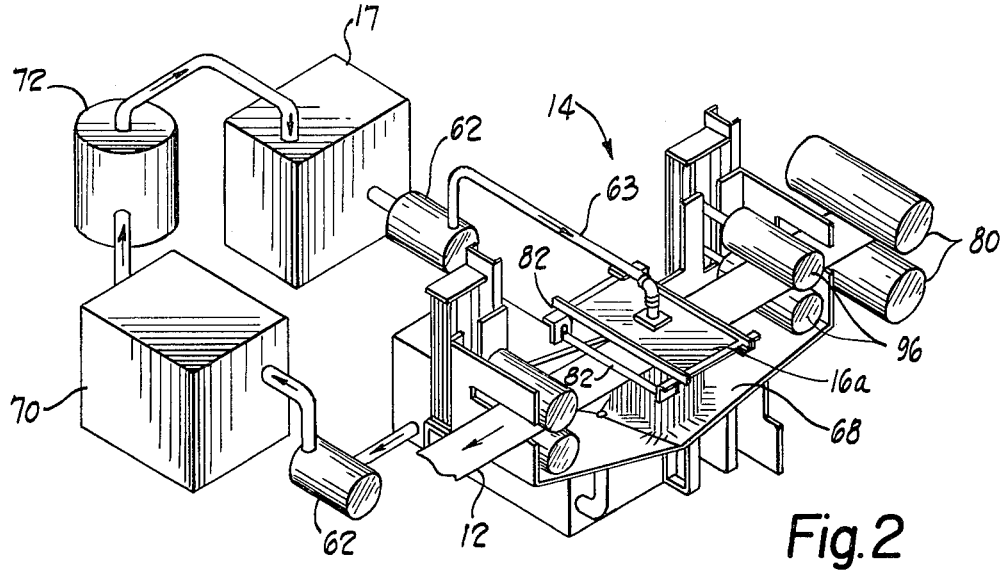
FIGS. 2–6 illustrate structural configurations of various inventive aspects of an embodiment of the invention incorporated in the plating line of FIG. 1.

The one side only plating system 10 as shown comprises a plating unit shown at 14 in FIG. 2. The plating unit comprises an anode 55 spaced above the workpiece, and is constructed to receive a plating solution. For illustration purposes, only one anode has been shown, but it should be appreciated that a commercial plating line may include 30 or more of these. The solution is circulated from a reservoir 57 of plating material via two pumps 62 and a conduit 63. From the conduit the solution enters the anode 14 from which it exits to flow over the workpiece.

The anodes are suspended above the workpiece with a small gap maintained between the workpiece and the anode. Plating solution fills this gap after it exits the anode and then flows off the workpiece and is collected by a sump 68. The collected solution then proceeds to a reaction station 70, through a filter 72, and to the main reservoir to be recirculated to the anode. In the schematic illustration shown in FIG. 2, the sump 68 has been shown with one side broken away to illustrate solution flow from the workpiece.

As the plating process begins, a suitable zinc plating solution enters the anode with a ph ranging upwards to 4.5, preferably in a range of 1.5–2.5, and with a temperature greater than ambient and preferably about 60° C. This solution is prepared with technical grade zinc sulfate salts and purified with carbon and zinc dust. The zinc sulfate salts dissociate and provde zinc ions for the plating.

The workpiece and anode are maintained at different electrical potential by a source of electrical energy such as provided by a D.C. rectifier. This energy difference causes electroplating to occur on the workpiece due to electron flow from the anode to the workpiece. The electroplating reaction follows the known equation $2e^- + Zn^{++} Zn^{\circ}$. Electrons necessary to complete this reaction flow through the anode which must therefore comprise a metallic or suitable conductive material. In one embodiment of the invention, the anode is constucted from a lead-silver alloy material. One corrosion resistant material suitable for anode construction comprises ½% silver and 99½% lead.

Rectifier current is controlled by a control module with a control output proportional to line speed and steel strip width. Details of this rectifier current control can be found in co-pending U.S. patent application Ser. No. 8,594 entitled "Plating Control" which has been assigned to the assignee of the present invention and which is incorporated herein by reference.

As the plating is deposited on the workpiece, the zinc ion concentration diminishes. To maintain ion concentration, the reservoir 17 is continually replenished with zinc ions at the reaction station 70. A preferred ion replenishment is accomplished by placing metallic zinc and zinc oxide in the plating solution contained in the reaction station. As the plating out of zinc ions occurs sulfuric acid is generated at the anode. This acid is used to aid in the solution of the metallic zinc and zinc oxide to produce zinc sulfate which dissociates to create zinc ions for the plating procedure.

Relative longitudinal motion between the anodes 16*a* and the workpiece 12 is applied by drive rollers 80. The current density on the workpiece, the desired plating thickness and the number of anodes, dictate how fast these drive rollers should drive the workpiece.

The gap width between the anode 16*a* and the workpiece 12 is adjustable. This adjustment is achieved by a guide roller 82 positioned on either side of the unit 16*a*. As the guide rollers are moved up or down relative to the anode, the gap between workpiece and anode either diminishes or increases.

Figure 3:
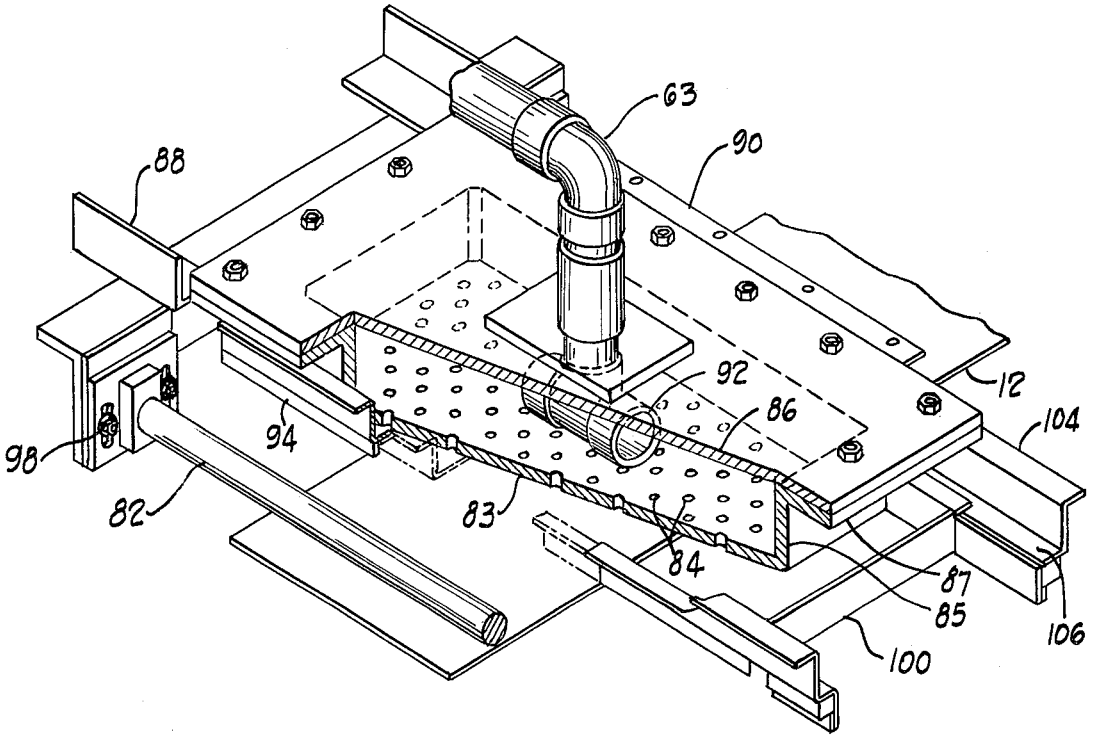
Figure 4:
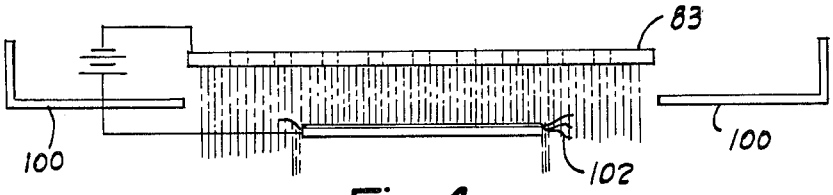
Figure 5:
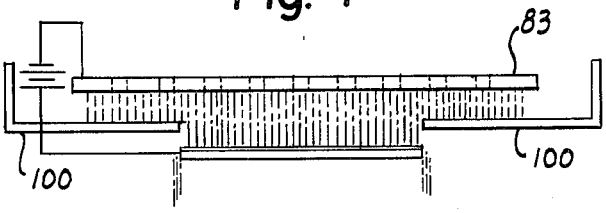

One preferred embodiment of the anode unit 16*a* is illustrated in FIG. 3. It is a rectangular shaped container with a bottom surface 83 which includes a number of $\frac{1}{4}''$ diameter apertures 84 for allowing the plating solution in the anode to flow to the workpiece 12. In addition to the plating surface, the anode container includes four wall surfaces 85 which form the container. A top 86 is bolted to the anode along a flange 87 extending around the perimeter of the anode container. The anode is maintained above the workpiece by a frame 88 to which the anode is bolted. The top is of a non-conducting material such as Lucite (registered trademark) and helps maintain a contact bar 90 in place. The contact bar 90 serves as a convenient method of attaching the anode to a DC source of electrical potential for maintaining current flow for the plating reaction.

In the embodiment illustrated, the conduit 63 is seen to enter the anode container from the top. Once inside the anode, the conduit can branch into a "T" or other appropriate fittings 92 which routes the plating solution to either side of the anode container.

The pressure supplied by the pump 62 can be adjusted to alter the fluid flow through the anode. Higher pressure results in faster fluid flow through the apertures and insures that the gap between the workpiece and the anode remains filled during the plating operation. The flow necessary to maintain a full volume of electrolyte in the gap is dependent on the cross-sectional area of the overflow from the gap to the sump. This area is the anode length times the anode to workpiece distance. Overflow on the exit and entrance ends can be minimized by a baffle 94 positioned at either end of the anode. (see FIG. 3). The baffle extends across the width of the anode and directly contacts the workpiece to force the solution from the sides of the workpiece into the sump. Should solution seep past the baffle, a pair of squeegee rolls 43, 96 (see FIG. 2) prevent solution flow past the sump.

Tests indicate that the flow rate required to maintain a completely filled gap is roughly proportional to the overflow area. Thus, if the gap width is halved while the anode length maintained a constant, the solution flow rate needed to fill the gap can also be halved.

FIG. 3 illustrates the guide rollers 82 which position the workpiece in relation to the anode unit. By loosening a pair of connectors 98 on either side of the rollers 82, the vertical positioning of the guide rollers can be adjusted. This adjustment fixes the gap between the workpiece and the anode. Through modification of the anode/workpiece distance, the user can empirically insure the gap is completely filled with solution and thereby achieve maximum plating current flow.

Positioned beneath each plating anode unit 16*a* are two masking plates 100 which are moved in and out of the plating solution flow. These masking plates are adjusted to restrict current flow to the workpiece edges and thereby prevent two undesirable phenomena known as edge buildup and tree growth. In the preferred embodiment of the invention, these masks comprise either stainless steel plates 1.9 mm thick coated with 1.0 mm of paint to insure electrical insulation, or a suitable nonconductive material, such as plastic.

Tree growth and edge buildup can occur when the plating solution is allowed to flow unrestricted from the anode to the workpiece. Tree growth is illustrated schematically at 102 in FIG. 4. The filamentary so called "trees" grow along the edge of the workpiece and degrade the plating near the workpiece edge. Edge buildup is a phenomenon where macroscopic nodules appear along the workpiece edges and result in a nonuniform plating.

Tests have shown that by continuously masking off a portion of the current flow, it is possible to eliminate these phenomena. During plating, the masking plates are positioned so that, depending on operational current density, their edges nearly coincide with or overlap the edge of the workpiece (see FIG. 5). With the masks in this position, it has been observed that neither the trees nor the nodules appear along the edge of the workpiece. Excess plating deposition on or close to the strip edge is prevented because current path is not continuous beyond the strip edge.

One technique for mounting the plating masks is shown in FIG. 3. A mask plate guide 104 is attached to the frame 88 and is therefore fixed in relation to the anode unit. The masks 100, slide along a region 106 of the guide parallel to the anode plating surface. The vertical positioning of the guide 104 is such that by sliding the mask 100 along this region 106, the mask reduces the area of current flow within the gap between the anode and strip. Positioning of the masks varies depending upon the width of the material to be plated. Should adjustments be deemed necessary due to tree or nodule growth, the masking plates are moved to the desired position manually or automatically along the guide 104. In this way, the plating user maintains control over the masking width and can vary that positioning depending upon the results obtained during the plating process.

It should be appreciated that certain design modifications could be incorporated without departing from the scope of the invention. In particular, it should be noted that the anode units can be positioned in a vertical configuration and the plating solution pumped onto a vertically positioned workpiece. The solution contacts the workpiece and the anode momentarily and then flows off the workpiece due to gravitational forces. It is also possible, as described in more detail below, that the anode may be positioned below the workpiece and solution may be forced into a gap between workpiece and anode and allowed to flow off the sides of the anode.

In operation, the drive rollers move the strip workpiece past the anode units as the plating solution is pumped from the source 15 to the units 20 and onto the workpiece. The number of anode units necessary to achieve proper plating thickness depends upon workpiece speed, the plating current density and the thickness required. The potential difference between anode and workpiece causes the plating reaction and current uniformity is maintained by insuring the gap remains filled. For different gap widths, solution flow is monitored and adjusted to assure current continuity.

Figure 6:
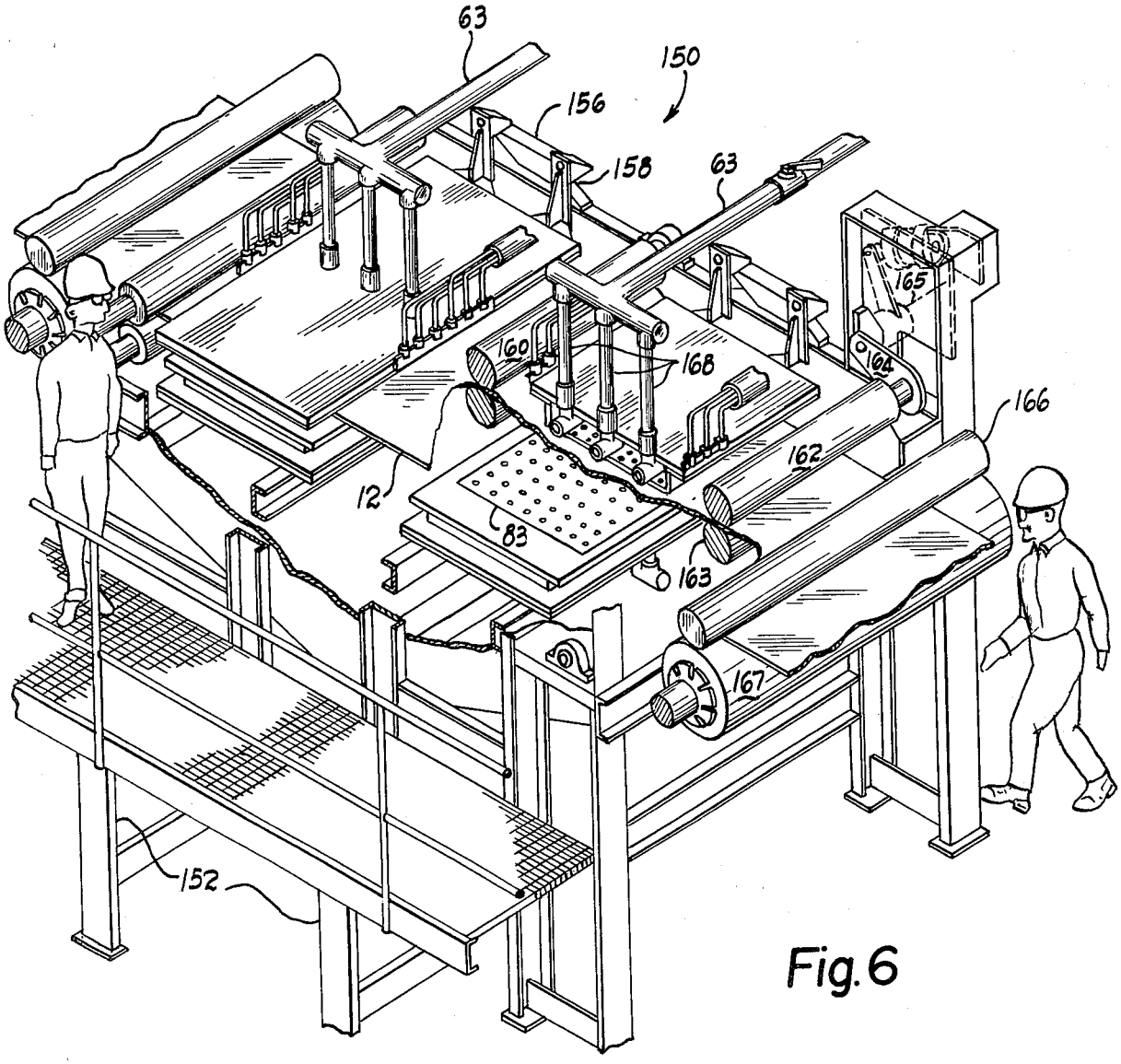

Referring now to FIG. 6, a two anode plating station 150 is illustrated. This station comprises a framework 152 for mounting two anode units and a number of rollers. The rollers maintain relative position of the strip and anodes, and in addition maintain electrical potential differences between the two.

As was the case for the anode unit shown in FIG. 3, each unit depicted in FIG. 6 comprises an insoluble anode as illustrated in and described in connection with FIG. 3. The anode container has a number of holes in its bottom for allowing plating solution to flow from the inlet conduit 63 to the strip 12 of steel as it passes through the station. The anode containers in FIG. 6 rest upon a framework 156 which is connected to an adjustable portion 158 of the framework 152. The support 156 defines a box-like structure with an appropriate inside dimension for receiving the anode flange 87. Since the framework 152 and support 156 are fixed in relation to their surroundings, the anode is similarly fixed.

Attached to the framework 152 are a pair of positioning rollers 160 and squeegee rollers 162, 163. The positioning rollers 160 serve to position the strip of steel at a fixed distance from the anode surface as it passes by the plating station. The squeegee rollers 162, 163 prevent plating solution from flowing along the strip past the sump edges where it might interfere with the electrical contacts to the strip. The top squeegee roll 162 is rotatably mounted to a bracket 164 attached to the framework 152. The bracket 164 is mounted to pivot about an axis 165 parallel to the strip's surface. This rotational freedom allows the squeegee to accommodate strips of varying thickness and also to accommodate irregularities in the strip.

Also shown are a hold down roll 166 and a contact roll 167. The contact roll is used to maintain the strip at a constant electrical potential as it passes past the station. As its name suggests, the hold down roll merely helps maintain the strip in its path of travel past the plating station.

The conduit 63 shown in FIG. 6 branches into three inlets 168 which insure solution flow completely fills the anode container. As was the case with the embodiment shown in FIG. 3, each unit terminates with a tee outlet for injecting fluid into the container holes it passes to the strip, and then flows off the strip edges into the sump for recirculation and replenishment as the plating process continues.

Figure 7:
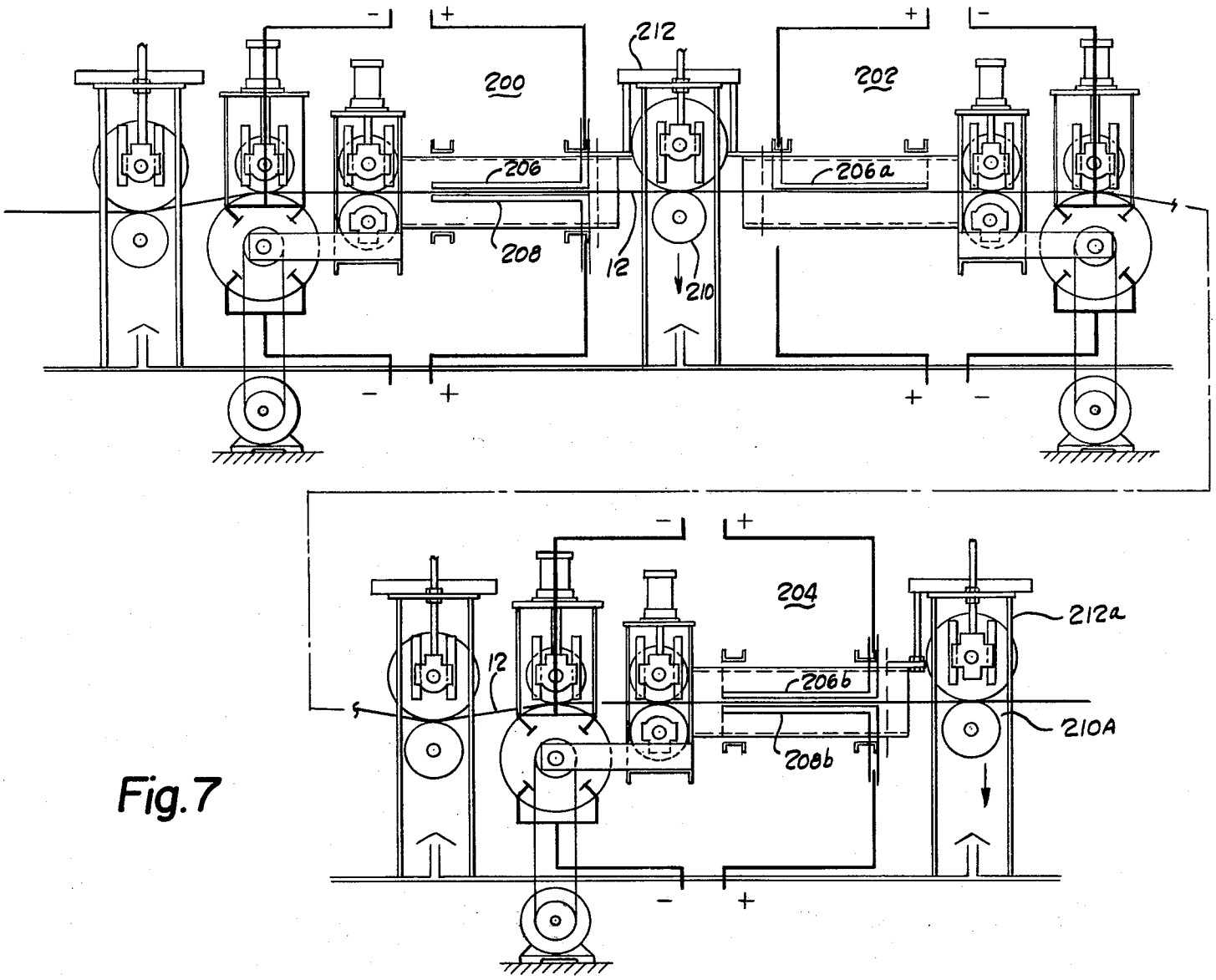
FIGS. 7 and 7A are elevational views of other embodiments of inventive aspects of the system illustrated in FIG. 1.

Principles utilized in connection with the one side plating apparatus described in connection with FIGS. 2-6 can also be employed in two sided plating. FIG. 7 shows an example of a two sided plating system incorporating these principles. Two sided plating, in addition to offering the obvious advantage of plating simultaneously both sides of the strip workpiece, also provides the flexibility of differential plating, i.e., application of plating of different thickness to opposite sides of the strip.

Referring to FIG. 7, there is shown a portion of a plating line incorporating three plating units 200, 202, 204. The first and last plating units 200, 204 each include a top anode **206, 206*b* and a bottom anode 208, 208*b* located respectively on the upper and lower sides of the strip path. The middle plating unit 202 includes only a top anode 206*a* positioned above the strip path. The anodes of FIG. 7** are, for purposes of simplicity, shown schematically, but are to be understood as constructed in accordance with the more specific descriptions herein for anode structure.

In the embodiment of FIG. 7, each top anode is similar to the anodes described in connection with the embodiment of FIGS. 2-6. Their principle of operation is also similar.

The bottom anodes, **208, 208*b***, as described in more detail below, include structure for injecting plating fluid into the gap between the top of the bottom anode and the underside of the strip to be plated. Fluid forced through the anode fills the gap therebetween, whereby plating is effected, after which the fluid falls back to the sump. Specifics of particular injection anode configurations are discussed in detail below.

Figure 7A:
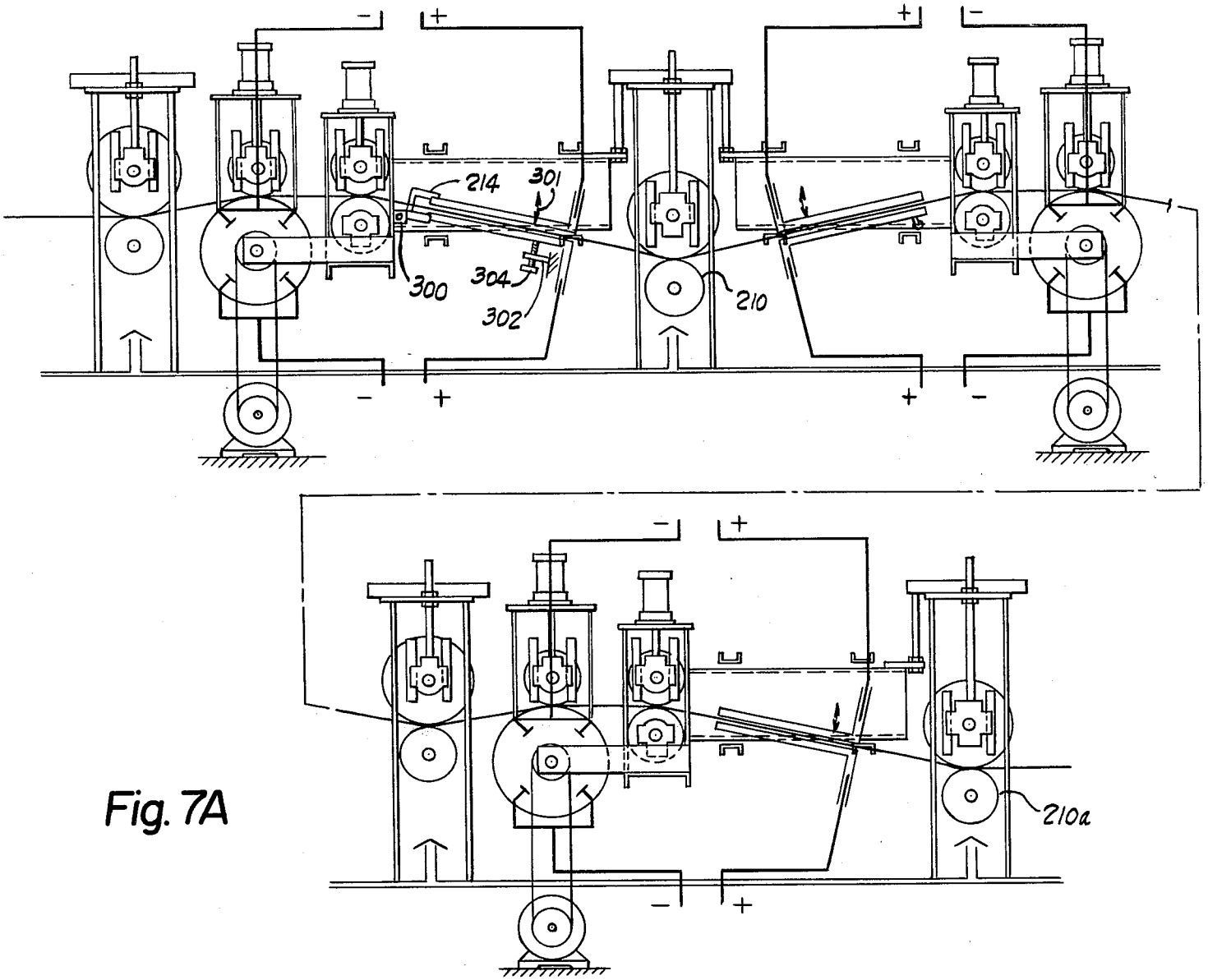

The plating system embodiment illustrated in FIG. 7A operates similarly to that of FIG. 7, but also provides the means to insure air and gas removal from the underside of the strip; to increase the metal ion supply, and to maintain strip flatness. These conditions increase plating rate and coating uniformity as discussed above.

More specifically, FIG. 7A shows means and structure for inclining to the horizontal both the plating anodes and the strip path, such that, in the plating unit regions, the strip is inclined approximately 5°. Tests have shown that even this small inclination can markedly improve plating uniformity and performance. FIG. 7A exaggerates this inclination for purposes of clarity.

In order to achieve this flexibility, the system of FIG. 7A incorporates structure for adjusting the height of deflecting rollers 210, 210A, along the path of the strip. Additionally, the system includes pivot structure for changing the attitude of the anodes simultaneous with the inclination of the strip path.

The deflection rollers are mounted on appropriate slotted stationary vertical members **212, 212*a*. Adjustable journal and support structure for the deflection rollers can be provided by one of ordinary skill to rotatably fasten each end of the deflection rollers at an adjustable height in a slot. When the deflection rollers are lowered, the path of the strip is deflected downwardly, such that the strip, during its passage through the adjacent plating units and between the anodes, is inclined as shown in FIG. 7A**. Complementary pivot adjustment mechanism pivotably couples the anodes to the frame such that the anodes can be similarly inclined when the deflection rollers are lowered. The specific nature of this pivot structure is within the realm of ordinary skill to provide.

An example of the pivot structure is shown at 214. It is to be understood that each plating unit has a substantially identical pivot mechanism associated with its anodes, even though only one such mechanism is shown.

The pivot mechanism includes a rigid arm structure to which both the upper and lower anodes are fixed. The arm structure is journalled to the frame to afford rotatable motion of the anodes in the directions indicated by the arrows 301.

An adjustable stop is provided to determine the degree of downward inclination of the anodes to the horizontal. The stop mechanism includes a flange 302 anchored with respect to the frame. A threaded hole through the flange accommodates a threaded bolt 304. The bolt limits the anode pivoting such that the anodes are stopped at an orientation determined by how far the bolt is screwed through the flange.

Figure 8:
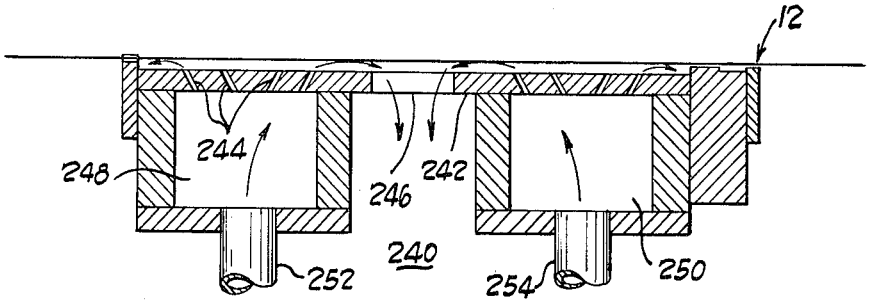
FIGS. 8–9 are cross-sectional views of portions of the system illustrated in FIG. 7.
Figure 9:
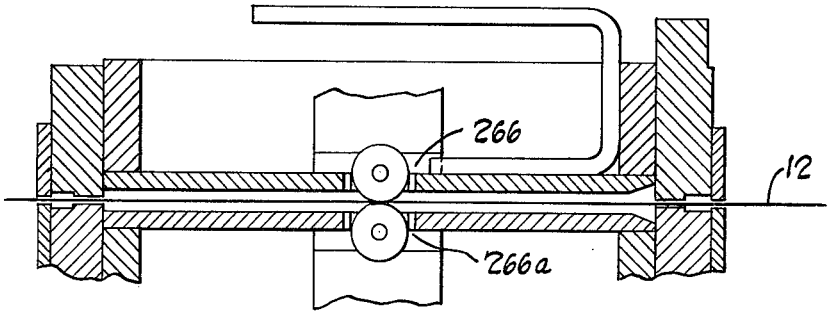
Figure 10:
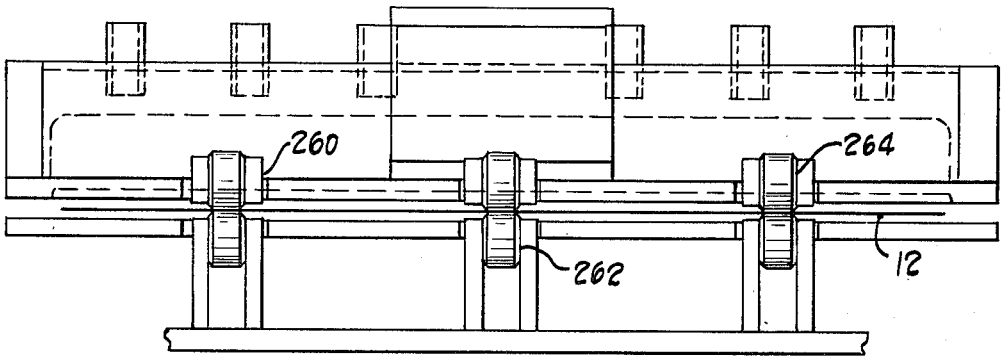
FIG. 10 is an elevational view showing in detail the portion of the system of FIG. 7 illustrated in FIG. 9.

FIGS. 8–10 illustrate alternative embodiments of the anodes and associated elements.

FIG. 8 illustrates one such type of anode.

A bottom anode 240 is shown in FIG. 8. This lower anode consists of a top portion 242 having a number of small divergent apertures 244 and a large central aperture 246. Additional structure defines plating fluid chambers 248, 250 beneath the area incorporating the smaller apertures. Plating fluid from the supply is forced upwardly through conduits 252, 254 to the plating chambers, from which it exits upwardly into the gap. Plating fluid exits downwardly from the gap by way of the large central opening in the anode, and also by falling from the outside edges of the gap.

As discussed above, the uniformity and effectiveness of plating can be adversely affected by bowing of the strip workpiece in the region of the plating anode. This results from undesirable nonuniformity in the gap width on both sides of the strip. FIGS. 9 and 10 illustrate one means of reducing this bowing in the area of the anodes by the use of appropriately positioned rollers to more adequately support the strip within the gap.

Particularly as shown in FIG. 10, three pairs of rollers 260, 262, 264 are disposed in a line perpendicular to the strip path across its width. Preferably, the rollers are spaced about 18 inches apart and are approximately 3 inches in diameter, and are journalled to the anodes in a manner derivable by use of ordinary skill. As shown in FIG. 9, notches **266, 266*a*** are provided in both the upper and lower anodes in order to accommodate the row of rollers.

It is to be understood that the disclosure here provided is illustrative, rather than exhaustive, of the invention. Those of ordinary skill in the relevant technical field will be able to provide additions, deletions and modifications to the specific structure set forth here without departing from the spirit or scope of the invention, as delineated in the appended claims.

I claim:

1. A method for plating a surface of a metallic strip comprising the steps of:

(a) providing a source of electric potential difference between the strip and an electrode;

(b) substantially filling space between said surface and said electrode with sufficient plating solution to establish a current flow path between the electrode and the surface;

(c) providing a sump for receiving gravity flow of solution off the strip while maintaining separation of the workpiece and the solution in the sump; and (d) shielding from solution impingement a portion of the strip side facing the electrode by use of shielding means separated from the strip and from the electrode.

2. The plating apparatus of claim 1 wherein the anodes are positioned both above and below the strip to plate both strip surfaces and wherein the strip path of travel in the vicinity of the anodes is inclined with respect to the horizontal.

3. A process of electroplating steel strip comprising the steps of:

(a) positioning a plating anode and a metal strip workpiece in closely spaced relationship to define a fluid flow path therebetween;

(b) flowing a liquid ion-containing plating solution toward the strip in sufficient volume to establish an electrical flow path from the anode to a facing surface of the workpiece with the electrical flow path being established across a portion of the surface and providing non-solution retaining shielding structure for facilitating substantially unrestricted gravity flow of said solution off the strip from along the sides of said strip while shielding a portion of the strip from direct solution impingement;

(c) establishing an electrical potential difference between the anode and the workpiece such that a flow of current causes ions in the plating solution to form a coating on the workpiece;

(d) collecting plating solution flowing from the fluid path at a location spaced from the strip;

(e) replenishing the ion concentration in the collected solution; and, (f) flowing the replenished solution along the fluid flow path.

4. Apparatus for plating a surface of a metallic strip comprising:

(a) means for providing a potential difference between the strip and an electrode;

(b) a sump;

(c) means for substantially filling space between said surface and said electrode with sufficient plating solution to establish a current flow path between the electrode and the surface without submerging the electrode or the strip in the sump and for allowing gravity flow of said solution off said strip surface into the sump; and (d) insulative masking structure spaced from the workpiece and the electrode and interposed between the electrode and the sump.

5. Apparatus for electroplating steel strip workpiece comprising:

(a) means for positioning one of a plurality of superimposed anodes and a steel workpiece in closely spaced non-submersed relationship to define a fluid flow path therebetween said one anode being substantially electrically isolated from other anodes;

(b) structure for flowing an ion-containing liquid plating solution along the path in sufficient volume to establish an electrical flow path from the anode to a surface of the workpiece and then to fall by gravity from the workpiece, with the electrical flow path being established across the surface;

(c) means for establishing an electrical potential difference between the anode and the workpiece such that a flow of current causes ions in the plating solution to form a coating on the workpiece.

6. The apparatus of claim 5 which further comprises structure for providing relative movement between the source and the workpiece and wherein the gravity flow is partially restricted to flow off said plating surface along a substantially non-obstructed escape path lateral to the direction of relative movement.

7. The apparatus of claim 4 wherein the workpiece is a strip of steel and the source comprises a box-like anode insoluble in the solution with a planar surface defining holes therein confronting the strip and the apparatus further comprising means for pumping solution into the box-like anode and facilitating gravity flow of solution through the holes.

8. A method of electrogalvanizing one side of a steel strip comprising the steps of:

(a) preparing a liquid plating solution with zinc ion concentration for contacting the side;

(b) positioning in a non-submersed location a box-like anode insoluble in said solution above the strip; said anode including a plurality of apertures spaced about a planar bottom surface;

(c) moving the steel strip under the anode with the one side parallel to and facing the planar anode surface;

(d) pumping the liquid solution into the box anode and allowing solution flow through the anode holes to the gap between anode and strip; said apertures spaced to allow the solution to substantially fill the gap thereby providing an electrical current path between the anode and the one side;

(e) allowing substantially unrestricted solution flow off the strip to a sump positioned beneath the strip while shielding a portion of the strip by use of non-contacting masks spaced from both the anode and the strip;

(f) establishing an electrical potential difference between the anode and the strip to establish an electrical current flow along the electrical current flow path to provide a zinc coating to the one side;

(g) adjusting the plating rate and strip speed to achieve desired coating thickness along the one side of the strip;

(h) collecting solution in the sump and pumping it to a replenishing station and replenishing the zinc ion concentration in the solution; and (i) recirculating replenished solution to the anode to recontact the one side of the strip.

9. Plating apparatus for electrogalvanizing one surface of steel strip as it moves past a plating station comprising:

(a) a supply of plating solution with zinc ions in solution;

(b) a box-like anode insoluble in said solution positioned in a non-submersed location above the strip with a planar bottom surface parallel to and confronting the strip; said bottom surface defining a plurality of apertures;

(c) means for pumping solution into the anode under sufficient pressure to cause solution flow through the holes to contact the strip while maintaining an electrical flow path in said solution between the anode and the strip;

(d) a source of electrical energy coupled to both the anode and the strip to maintain the workpiece and the anode at different electrical potentials to produce a plating current to coat the strip;

(e) means for adjusting the distance between the strip and the anode to insure the plating solution substantially fills the gap between said anode and the strip; and (f) means for collecting the solution as it flows off the strip and returning collected solution to the supply of plating solution, and (g) shielding means spaced from the strip and anode and interposed between the anode and strip.

10. The apparatus of claim 9 wherein the means for adjusting comprises a guide roller which contacts a top surface of the strip and whose vertical position in relation to the anode is adjustable depending on the desired gap width between the anode and the strip.

11. A method for electroplating a generally flat metallic workpiece supported above the liquid level of a sump containing plating solution by use of a first generally flat electrode suspended above and parallel to the upper surface of the workpiece and by use of another electrode, said method comprising the steps of:

(a) substantially filling the space between the first electrode and workpiece surface with plating solution by causing downward impingement of plating solution on the upper surface of the workpiece;

(b) applying electrical potential between the first electrode and the workpiece to effect plating;

(c) at least partially shielding a portion of the workpiece surface from direct solution impingement thereon without contacting the workpiece by use of masking structure between the first electrode and the workpiece surface, said masking contacting neither the strip nor an electrode, while avoiding retention in the masking structure of substantial amounts of plating solution; and (d) substantially preventing electric current flow between the first electrode and said another electrode.

12. A system for electroplating a metallic workpiece having a generally flat surface, said system comprising:

(a) a sump for containing plating solution;

(b) means for supporting the workpiece spaced above a level of solution in the sump;

(c) an electrode having a generally flat surface positioned proximate and facing a workpiece surface and being generally parallel thereto;

(d) apparatus for substantially filling the space between the workpiece surface and electrode surface with plating solution;

(e) electrical means for applying an electrical potential difference between the workpiece and the electrode for effecting plating, and (f) structure associated with the electrode and the workpiece supporting means for adjustably varying inclination of the workpiece surface and electrode surface from the horizontal.

13. A method for electroplating a metallic workpiece supported above the liquid level of a sump containing plating solution by use of an electrode having a generally flat bottom surface suspended above the upper surface of the workpiece, said method comprising the steps of:

(a) substantially filling the space between the electrode and workpiece surface with plating solution by causing impingement of plating solution on the upper workpiece surface;

(b) applying electrical potential between the electrode and the workpiece to effect plating; and (c) at least partially shielding a portion of the workpiece surface from direct solution impingement thereon without contacting the workpiece itself by the use of masking structure locatable between and not contacting the electrode and the upper workpiece surface while avoiding retention in the masking structure of plating solution.

* * * * *

UNITED STATES PATENT AND TRADEMARK OFFICE

CERTIFICATE OF CORRECTION

PATENT NO. : 4,367,125

DATED : January 4, 1983

INVENTOR(S) : Richard C. Avellone

It is certified that error appears in the above-identified patent and that said Letters Patent is hereby corrected as shown below:

Column 6, line 17, "55" should be --16a--;

Column 6, line 22, "57" should be --17--.

Signed and Sealed this

*Twenty-sixth* Day of *April 1983*

[SEAL]

*Attest:*

GERALD J. MOSSINGHOFF

*Attesting Officer*

*Commissioner of Patents and Trademarks*